US005483908A

United States Patent [19]

Nolle

[11] Patent Number: 5,483,908

[45] Date of Patent: Jan. 16, 1996

[54] BLOWING DEVICE ON A SEWING MACHINE FOR UNCURLING THE EDGE OF SEWING MATERIAL

[75] Inventor: Wolfgang Nolle, Albstadt, Germany

[73] Assignee: Union Special GmbH, Hemmingen, Germany

[21] Appl. No.: 189,692

[22] Filed: Feb. 1, 1994

[30] Foreign Application Priority Data

Feb. 10, 1993 [DE] Germany ..... 93 01 861.4

[51] Int. Cl.[6] ..... D05B 35/02; D05B 35/10; D05B 81/00

[52] U.S. Cl. ..... 112/150; 112/141; 112/153; 112/DIG. 2

[58] Field of Search ..... 112/150, 153, 112/141, 143, 147, 136, DIG. 2, DIG. 3, 2

[56] References Cited

U.S. PATENT DOCUMENTS 3,099,970 8/1963 Hite ..... 112/DIG. 2 X
3,204,590 9/1965 Rockerath et al. .
3,204,591 9/1965 Pickett ..... 112/DIG. 2
4,003,323 1/1977 Crawford et al. ..... 112/141
4,315,471 2/1982 Torre et al. ..... 112/153
4,928,610 5/1990 Akutsu ..... 112/DIG. 2 X

FOREIGN PATENT DOCUMENTS 1541268 2/1979 United Kingdom .

*Primary Examiner*—Peter Nerbun
*Attorney, Agent, or Firm*—Willian Brinks Hofer Gilson & Lione

[57] ABSTRACT

A sewing machine having a blowing device which comprises an angularly constructed step, into which opens an opening from which a gas stream blows towards a curled edge of a workpiece for the purpose of uncurling the edge of the workpiece.

8 Claims, 2 Drawing Sheets

BLOWING DEVICE ON A SEWING MACHINE FOR UNCURLING THE EDGE OF SEWING MATERIAL

BACKGROUND OF THE INVENTION

The invention relates to a sewing machine and, more particularly, to a blowing device for uncurling an edge of a workpiece.

A blowing device is shown in U.S. Pat. No. 3,204,590 in which two edges from two plies of a workpiece are uncurled by means of compressed air. A lower air stream at the same time blows against the curled edge of a lower workpiece ply. The air stream flows between the workpiece ply with the curled edge and a base plate of a workpiece conveying device. This device may be a hindrance when hemming individual parts of a workpiece, since it is disposed in front of the sewing machine and may hinder the operator when handling the workpiece.

Thus, an object of the invention is to design a blowing device of sufficiently compact construction to render it possible to uncurl the edge of the workpiece without hindering the operator.

SUMMARY OF THE INVENTION

The invention resides in a sewing machine having a needle plate with a point of stitch formation and a carrier for the needle plate. The invention further includes a blowing device for uncurling an edge of a workpiece by means of a gas stream. A step or recess, that is angularly disposed to the feed direction of the workpiece and located upstream of the point of stitch formation, has an opening, out of which the gas stream may be blown toward the curled edge of the workpiece.

The edge of the workpiece can thereby be uncurled reliably in a simple manner. This is accomplished by the step or recess being angularly disposed to the feed direction of the workpiece and an overlying cover plate. A stream of gas blows below the cover plate towards the curled edge of the workpiece.

The invention is further described, by way of example, with reference to the accompanying drawings, in which:

DETAILED DESCRIPTION OF THE PREFERRED EMBODIMENTS

Figure 1:
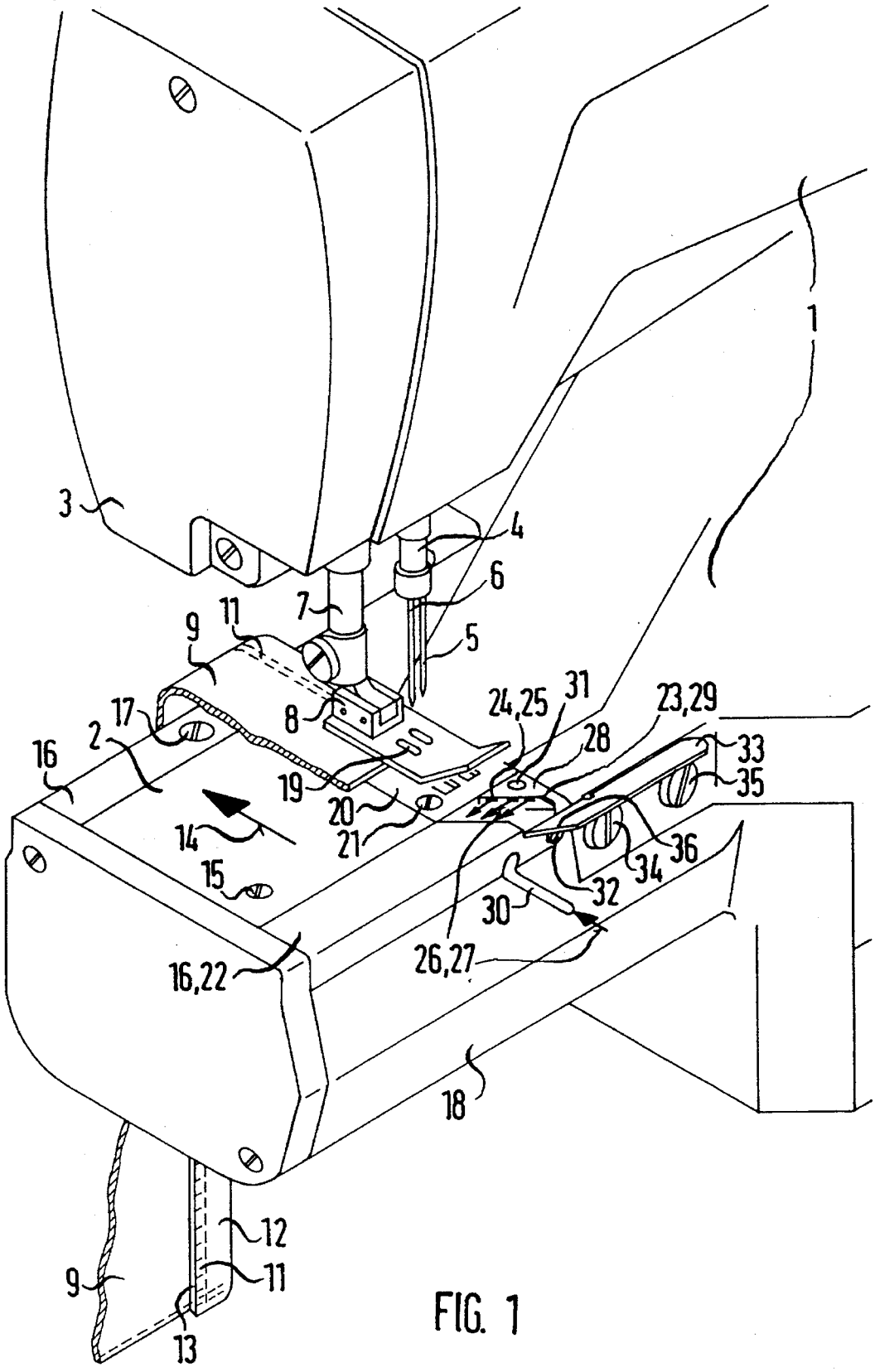
FIG. 1 is a fragmentary perspective view of a sewing machine having a blowing device.

Referring to FIG. 1, a sewing machine 1 has a workpiece support 2 and an upper part 3 in which a needle bar is mounted. Needle box 4 is driven upwardly and downwardly and carries needle 5 and 6 at its lower end. A presser bar 7, to which a presser foot 8 is secured, is resilient biased downwardly and is movable upwardly and downwardly. Presser bar 7 is disposed behind the needle bar 4. A workpiece 9 is fed beneath the presser foot 8, and an inwardly folded hem 12 having an edge 13 is formed on the workpiece 9 by means of a seam 11. The seam 11 can be, for example, a standard stitch type 401 and 406. The workpiece 9 is conveyed in a known manner in the workpiece feed direction indicated by an arrow 14.

The workpiece support 2 is secured by a screw 15 to a carrier 16 which is in turn secured to a bottom part 18 of the sewing machine housing by a screw 17. The carrier 16 also serves to accommodate a needle plate 20 which is formed with a stitch formation point 19 and which is secured to the carrier 16 by a screw 21. The front region of carrier 16 is formed as a transverse strip 22 in which a channel-shaped angular step 23, disposed across or obliquely to the workpiece feed direction. The angular step 23 extends upstream of the stitch formation point 19 in the region of the needle plate 20. The step 23 is preferably disposed obliquely at an angle of approximately 45° from front right to rear left. However it is only essential that the step 23 extends across the workpiece feed direction. An opening 24 formed in the vertical ledge of 23 has individual channels 25 from which a gas stream 26 blows towards the curled edge 13 of the workpiece 9. Four arrows 27 show the gas stream 26 which is normally available as compressed air.

The top or workpiece sides of channels 25 are covered by means of a plate 28 that is formed with an uncurling edge 29. The uncurling edge 29 is disposed across the workpiece feed direction, for uncurling the workpiece 9 and especially the edge 13 of the workpiece. The uncurling edge 29 is disposed parallel to a line in the workpiece support 2 extends and obliquely at an angle of approximately 45° from front right to rear left. It is also only essential here that the uncurling edge 29 extends across the workpiece feed direction. An angularly shaped hollow tube 30 conducts the gas stream 26 towards the opening 24 into the channels 25. The plate 28 is secured to the transverse strip 22 parallel to the workpiece support 2 by a screw 31 and at right angles to the workpiece support 2 by a further screw 32. The workpiece 9 slides across the plate 28 during the feeding of the workpiece. The gas stream 26 flows below the plate 28 against the curled edge 13 of the workpiece, and the edge 13 of the workpiece is as it is being uncurled pulled upper surface of plate 28.

A guide plate 33 is disposed in front of the step 23 and is secured to the bottom part 18 of the housing by screws 34 and 35. According to the type of workpiece, a guide edge 36 of the guide plate 33 may intensify or assist the action of the blowing device for uncurling the edge 13 of the workpiece.

An inwardly or outwardly curling edge 13 of the workpiece very frequently occurs by reason of the possible mesh structure of the workpiece, which may be influenced by the knit type, the mixture or the textile finishing. This results in outward curling of the edge, that is, towards the plain side when, for example, hemming single-ply fabric, such as single jersey. Single jersey is single-ply knitted and normally has an "inner purl side, outer plain side" workpiece character.

Figure 2:
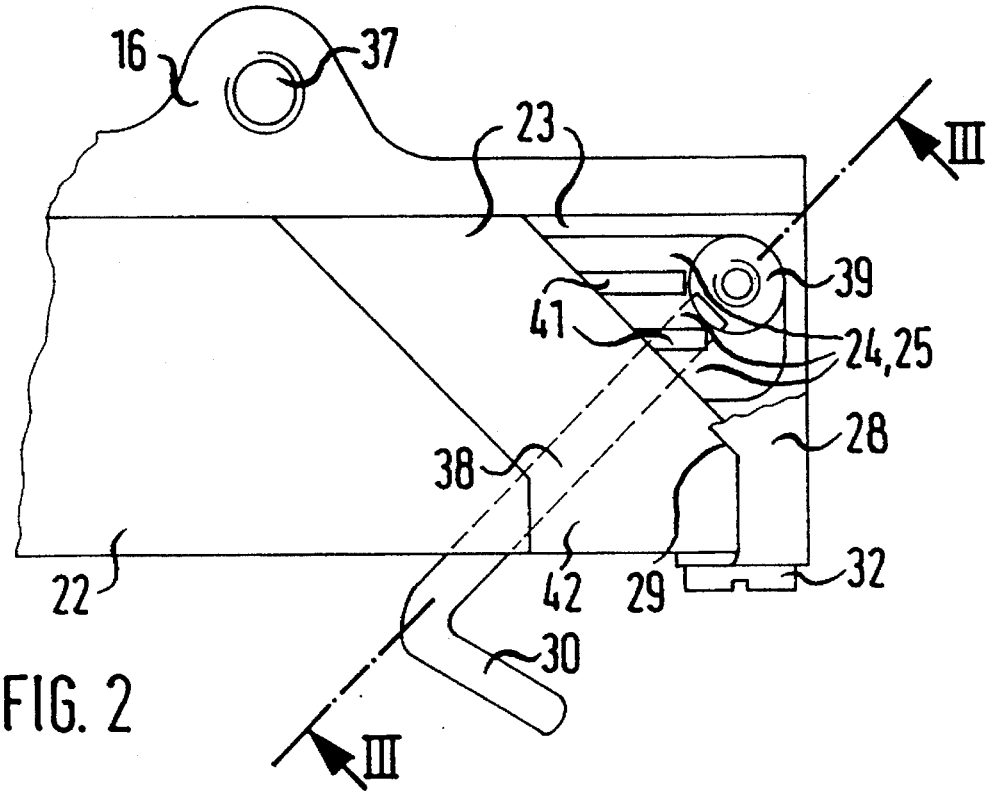
FIG. 2 is a plan view of the blowing device.

Referring to FIG. 2, the holder 16 has a threaded bore 37 for the securing of the needle plate 20. The hollow tube 30 opens into a horizontal bore 38 which in turn extends into a vertical bore 39 and thus conducts the gas stream 26 towards the opening 24 which is constructed into the form of channels 25. The opening 24 shown in the drawings is split up into three channels 25 by means of two webs 41.

Figure 3:
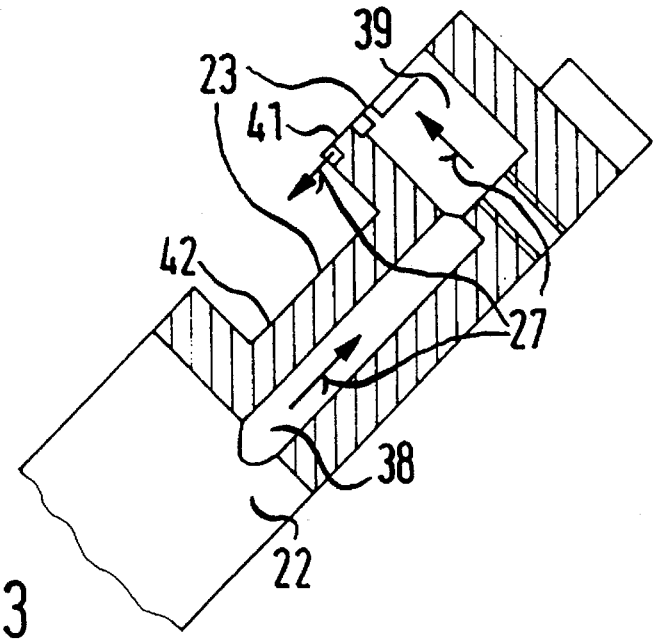
FIG. 3 is a cross section through the blowing device on the line III—III of FIG. 2.

The arrows 27 in FIG. 3 show the direction of flow of the gas stream 26 through the horizontal bore 38 into the vertical bore 39 and along the webs 41.

A recess 42 in front of the uncurling edge 29 renders it possible to guide, in a low-friction manner, the hem 12 to be sewn, with the edge 13 on the workpiece 9 still curled.

The action of the blowing device for the uncurling of the edge 13 of the workpiece results from the direction of the gas stream 26 transversely to the workpiece feed direction. In this connection, the workpiece edge 13 to be uncurled is applied to, or pulled against, the plate 28 in the uncurled state, whereby satisfactory and uniform overlapping of the workpiece edge 13 by means of the seam 11 is rendered possible. Normally, a non-curling workpiece 9 can be sewn at full sewing speed. However, a markedly curling workpiece 9 can only be guided to the point of stitch formation very slowly and uncurled manually. The uncurling device in the form of the blowing device substantially improves the handling of the workpiece 9 to be uncurled and sewn.

The angularly shaped hollow tube 30 is connected to a gas stream line (not shown in the drawings) by which the gas stream 26 in the form of, for example, compressed air is fed in a controlled manner to the workpiece 9 or to the workpiece edge 13 during the sewing operation. During stoppage of the sewing machine 1, the feeding of the gas stream is stopped by a known gas-flow valve arrangement, so that the consumption of the gas stream is minimized.

While the invention has heretofore been described in detail with particular reference to the illustrated apparatus, it is to be understood that variations, modifications and the use of equivalent mechanisms can be effected without departing from the scope of this invention. It is, therefore, intended that such changes and modifications be covered by the following claims.

What is claimed is:

1. A sewing machine having a needle plate with a point of stitch formation and a carrier for the needle plate, a blowing device for uncurling an edge of a workpiece by means of a gas stream, wherein a step including a wall is formed, as part of said carrier, upstream of the point of stitch formation and across a path extending along a feed direction of the workpiece, and an opening, out of which the gas stream may be blown towards the curled edge of the workpiece, opens into said wall of the step.

2. A sewing machine as claimed in claim 1, in which the opening comprises individual channels.

3. A sewing machine as claimed in claim 1, in which the step is disposed obliquely from front right to rear left at an angle of approximately 45°.

4. A sewing machine as claimed in claim 1, in which a guide plate is disposed in front of the step and has a guide edge.

5. A sewing machine as claimed in claim 2, in which said opening comprises individual channels and said channels are covered on their side adjacent the workpiece by a plate.

6. A sewing machine as claimed in claim 1, in which said opening comprises individual channels and said channels are covered on their side adjacent the workpiece by a plate.

7. A sewing machine as claimed in claim 5, in which an uncurling edge is formed on the plate and is disposed transversely to the feed direction of the workpiece for the purpose of uncurling the edge of the workpiece.

8. A sewing machine as claimed in claim 7, in which the uncurling edge is disposed parallel to a workpiece support and obliquely from front right to rear left at an angle of approximately 45°.

* * * * *